US009873032B2

(12) United States Patent
Makai

(10) Patent No.: US 9,873,032 B2
(45) Date of Patent: Jan. 23, 2018

(54) SKATE BLADE WITH IMPROVED PROPERTIES

(71) Applicant: Miklós Makai, Szabadbattyán (HU)

(72) Inventor: Miklós Makai, Szabadbattyán (HU)

( * ) Notice: Subject to any disclaimer, the term of this patent is extended or adjusted under 35 U.S.C. 154(b) by 0 days.

(21) Appl. No.: 15/127,646

(22) PCT Filed: Mar. 19, 2015

(86) PCT No.: PCT/HU2015/000026
§ 371 (c)(1),
(2) Date: Sep. 20, 2016

(87) PCT Pub. No.: WO2015/140587
PCT Pub. Date: Sep. 24, 2015

(65) Prior Publication Data

US 2017/0165558 A1 Jun. 15, 2017

(30) Foreign Application Priority Data

Mar. 20, 2014 (HU) ..... 1400158

(51) Int. Cl.
*A63C 1/32* (2006.01)
*A63C 1/34* (2006.01)

(52) U.S. Cl.
CPC . *A63C 1/32* (2013.01); *A63C 1/34* (2013.01)

(58) Field of Classification Search
CPC .... A63C 1/32; A63C 1/34; A63C 1/30; A63C 1/303
USPC ..... 280/11.18; 36/142, 115
See application file for complete search history.

(56) References Cited

U.S. PATENT DOCUMENTS 524,129 A * 8/1894 Bryant ..... A63C 1/32 280/11.18
2,150,964 A * 3/1939 Dornseif ..... A63C 1/30 280/11.18
4,392,658 A * 7/1983 Redmond ..... A63C 1/30 280/11.18
5,570,893 A * 11/1996 Swande ..... A63C 1/32 280/11.18
5,826,890 A * 10/1998 Swande ..... A63C 1/32 280/11.18

(Continued)

*Primary Examiner* — James A Shriver, II
*Assistant Examiner* — Brian L Cassidy
(74) *Attorney, Agent, or Firm* — Handal & Morofsky LLC

(57) ABSTRACT

Skate blade (10), which has an outside edge and an inside edge (2, 3), in the middle region (1) of which the outside edge and the inside edge (2, 3) are parallel and have the same height, and the blade has an anterior region (4) in front of the middle region (1), where the height (z) of the edges (2, 3) increases in forward direction relative to the height (z=0) assumed at the middle region, and it has a posterior region (5) behind the middle region (1), where the height (z) of the edges (2, 3) increases in rearward direction relative to the height (z=0) assumed at the middle region, and the width coordinate (y) of at least one edge (2, 3), at least in the anterior or in the posterior region (4,5) increases along and arched curve with the distance from the middle region (1) relative to the vertical central plane (6) interpreted at the middle region (1), and at every location in front or behind the middle region (1), where the width of blade (10) exceeds the value assumed at the middle region (1), both edges (2, 3) have height coordinate (z) exceeding zero at identical length coordinates (x).

4 Claims, 8 Drawing Sheets

(56) References Cited

U.S. PATENT DOCUMENTS

| | | | | |
|---|---|---|---|---|
| 6,523,835 | B1 * | 2/2003 | Lyden | A63C 1/30 280/11.12 |
| 6,830,251 | B2 * | 12/2004 | Titzmann | A63C 1/32 280/11.12 |
| 8,056,907 | B2 * | 11/2011 | Wilson | A63C 1/32 280/11.12 |
| 8,277,284 | B2 * | 10/2012 | Wilson | A63C 1/32 451/195 |
| 8,523,194 | B2 * | 9/2013 | Smirman | A43B 5/1641 280/11.18 |
| 2009/0020968 | A1 * | 1/2009 | Weber | A63C 1/30 280/11.18 |
| 2012/0104705 | A1 * | 5/2012 | Swist | A63C 1/32 280/11.18 |
| 2014/0225337 | A1 * | 8/2014 | Olson | A63C 1/32 280/11.18 |

* cited by examiner

SKATE BLADE WITH IMPROVED PROPERTIES

The subject of the invention is skate blade with improved turning properties, which has an external and an internal edge, at the middle region of which the external and the internal edges are parallel, and have the same height, and the blade has an anterior region in front of the middle region, in which the height of the edges increases in forward direction relative to the assumed height at the middle region, and it has a posterior region behind the middle region, in which the height of the edges increases in the rearward direction relative to the assumed height in the middle region.

Generally, the width of skate blades, i.e. the distance between the edges being in contact with ice, is constant. The bottom of the blade has a concave shape between the two edges, and the blade surface determining the edge is not vertical sometimes, but it has an angle with the vertical direction. Many recommendations are known already about the design of sides establishing the blade edge, and about the arch and shape of the concave region between the two (or sometimes more) edges.

The front and rear sections of the skate blade usually have an upward arched shape, meaning that they depart from the ice surface, so that they are in better harmony with its skewed alignment during turning, and that they facilitate the turning.

In order to facilitate turning, it was already recommended in U.S. Pat. No. 6,523,835 to increase the crosswise distance between the edges of the blade relative to the middle part of the blade (relative to the centre of gravity most of the time). The patent provides also a number of examples for the increase of blade width. In some examples the width is increased gradually already from the central point along a slight arch, while in other examples there is a middle section where the blade edges are parallel, and then the width increases both in forward direction and backward direction. The turning properties of the skate are improved by increasing the width according to the description. In the referred patent, however, the increase of the width of the skate blade is symmetric relative to the central axis, so the properties are valid for right turn, as well as for left turn.

It is a primary importance of skating, that the braking force acting on the edges should be minimum in the interest of striving and sliding forward and backward. The parallel edge design is used mostly because the braking force acting on the blade is minimum in this case, and it is the easiest to increase the speed with such edge design.

If the distance between the edges of the blade is increased gradually, then a force component perpendicular to the longitudinal direction will also act on the edges that diverge from each other somewhat, when moving forward or backward, which brakes the movement in straight direction. Therefore, the divergence of the blade edges is not always beneficial.

The primary objective of the invention is to create and edge design, which does not hinder the forward or backward movement of the skate, but it provides a positive improvement in the turning properties.

The body of the skater generally leans in the direction of the turning centre in known manner when making a turn, and as a result, the weight of the skater acts only on the edge towards the turning centre, while the other edge is in the air. As only one of the edges is loaded in this case, no braking force is created if the edges are not parallel.

It is not indifferent to what direction the turning is made, to the right or to the left, the weight of the skater generally acts on the internal edge of the shoe being towards the turning centre. Therefore, it is not indifferent to what direction the turning is made depending on the style of skating. If the edge carrying the weight is not straight (i.e. not parallel with the longitudinal axis of the blade everywhere), and it tends to get arched towards the centre of curvature of the turning in forward or backward direction, then this design facilitates the action of turning in the given direction. The optimum curvature, therefore, is not always the same generally, depending on the direction.

The essential object of the invention is to create an edge design, where the curvature of the edge carrying the load facilitates turning, but does not hinder the forward or backward sliding, and the edge shape that leans away the central plane cannot produce a braking effect.

The second object of the invention is to create an edge design, which is matched to the differences between turning right and turning left, and provides optimum curvature for the respective edges for turning in the given direction.

We recognised according to the invention, that it is not enough to make the blade edge arched outwards relative to the central plane of the blade, but the arching should occur when and where straight forward (or backward) movement cannot happen any more, and where the blade edge is above height z=0 in the basic state. The zero height can be interpreted at the section, where the blade edges are parallel. For this reason, the widened edge cannot produce braking force during movement in straight direction, because the widening section does not touch the ice, but has a certain height above it.

During turning, however, the body of the skater leans not only in lateral direction, but also forward or rearward depending on the turning radius, therefore, only one of the edges of the blade touches the ice, and at the same time, the varying height position of the blade edge facilitates the skater leaning forward (or backward).

For accomplishing the essential tasks, therefore, we crated a skate blade, which has an outside edge and an inside edge, at the middle region of which the outside edge and the inside edge are parallel and have the same height, and the blade has an anterior region in front of the middle region, where the height of edges increases in forward direction relative to the height assumed at the middle region, and it has a posterior region behind the middle region, where the height of edges increases in rearward direction relative to the height assumed at the middle region, and the width coordinate of at least one of the edges at least at the anterior region or at the posterior region increases relative to the vertical central plane interpreted at the middle region according to the invention, along an arched curve section with the distance from the middle region, and the two edges have height coordinates exceeding zero with the same length coordinates at all locations in front or behind the middle region, where the blade width is over the value assumed at the middle region.

The continuous arch and curvature can be accomplished, if the width coordinate of the edges in both the anterior and the posterior regions is increased with the increase of the absolute value of the length coordinate.

According to the second aspect of the invention, the increase of width of left edge is different from the increase of width of the right edge in order to optimize turning right and turning left.

As skates are sold in pairs, a right blade attached to the right shoe and a left blade attached to the left show belong to a pair of skating shoes, and it is beneficial according to a further recognition of the invention, if the right and left blades have edge sections that become widened along different arches.

In case of a preferred shape of design, the posterior region behind the middle parallel region has an edge section which becomes wider rearward along an arch on both blades, and in the given case the arches on the two blades are different.

Turning is particularly assisted, if widening sections are included in both regions (anterior and posterior) of both blades of a pair of shoes, but at opposite sides, the orientation of which on the right blade is different from the orientation on the left blade.

It is beneficial in this case if the skate blade is assembled from two parts (halves), which parts meet along the central plane.

In case of a preferred embodiment, the two parts are connected at two or more discrete locations by means of rivets.

Skating becomes a unique experience by using the blade designed according to the invention, the movement along a straight path is not hindered by anything, and the turning abilities are not only improved, but the eventual preferences of the skater can also be met, even when the skater desires different properties when turning to the left relative to the properties when turning to the right.

The skate blade according to the invention is described in more details with reference to examples of design shown in the drawings, where:

Figure 13A:
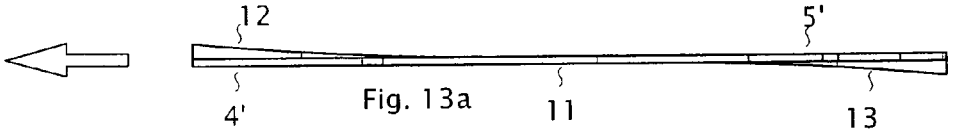
Figure 13B:
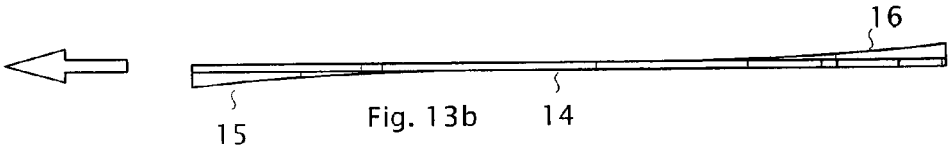
Figure 13C:
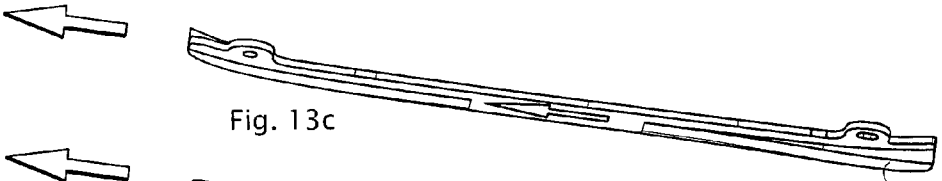
Figure 13D:
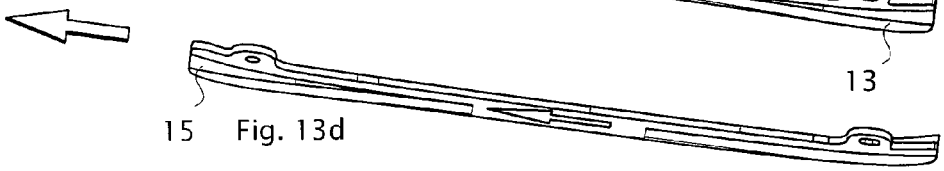
Figure 14A:
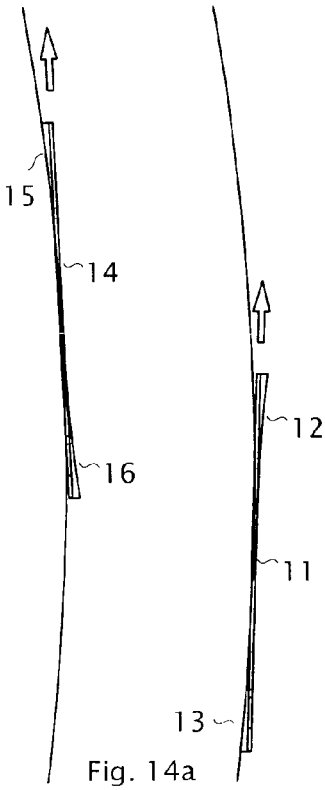
Figure 16A:
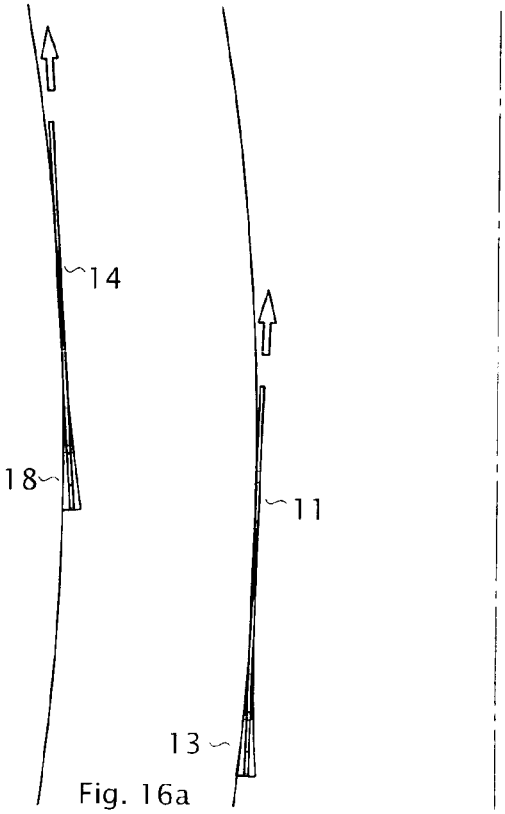
Figure 16B:
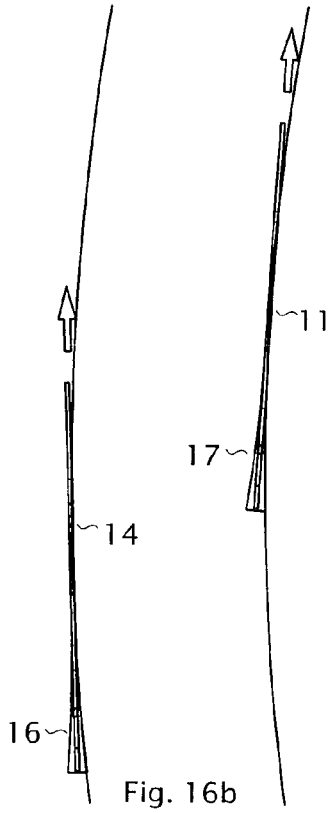

FIGS. 13*a-d* show the top view and axonometric view of left and right blades of a further asymmetric shape of design;

FIGS. 14*a* and *b* show the shape of design according to FIG. 13 while turning left and turning right;

FIGS. 15*a-d* show the top view and the axonometric view of the left and right blades which become wider at the rear only; and FIGS. 16*a-b* show the blades depicted in FIG. 15 while turning left and turning right.

Figure 1:
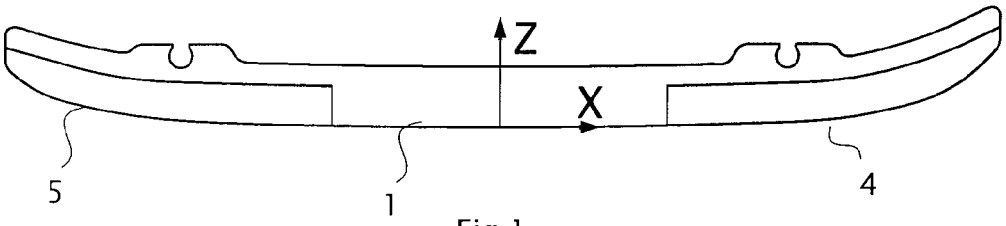
FIG. 1 is the front view of the skate blade, where the coordinates are indicated.
Figure 2:
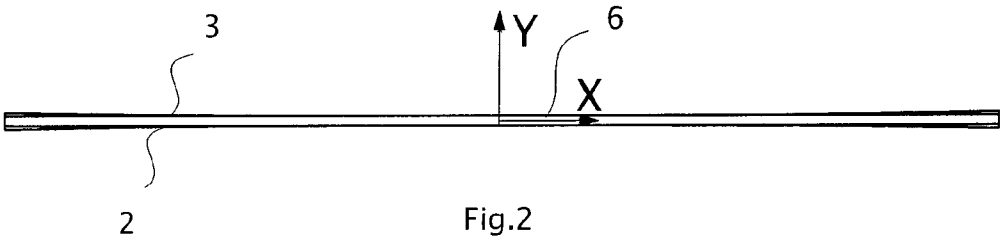
FIG. 2 is the bottom view of the skate blade, where the coordinates are indicated.

FIG. 1 and FIG. 2 show the front view and rear view of the skate blade 10 according to the invention, where the coordinate X, corresponding to the longitudinal direction, is depicted, together with a coordinate Y corresponding to the crosswise direction, and a coordinate Z corresponding to the height direction. The blade 10 has a middle region 1, where the two edges 2, 3 of the blade 10 are parallel and are located at the lowermost position, meaning that value of the height Z coordinate is zero all along the region. This design can be found in most of the known solutions, and the parallel alignment of the two edges 2, 3 ensures that no supplementary braking force acts on the blade 10 while moving forward or backward when the weight of the skater loads both edges, which otherwise could happen if the edges are not parallel. Skaters use this middle region 1 for accelerating (striving) and for moving straight ahead. The length of the middle region 1 could vary corresponding to the skill of the skater and to the nature of use, the most frequent dimension being in the range 30-130 mm.

In case of the shape designed as shown in FIG. 1 and FIG. 2, the width, i.e. the size in the coordinate y, of the blade 10 increases gradually along a slight arch at the anterior region 4 in front of the middle region 1, while the height, i.e. the size corresponding to coordinate z, of the edges 2, 3 also increases slowly along an arched curvature. The same is true for the posterior region 5 behind the middle region 1, except that the width and height increases in the direction of coordinate −x. The rate of changes are preferably different for the anterior region 4 and the posterior region 5, and the curvature of arch and the arched increase (curvature) of elevation, as well as the length of middle region 1, can be selected freely between given limits based on the style and requirements of the skater. The anterior region 4 and the posterior region 5 have role primarily when making turns during skating, when the skater loads only the edge towards the direction of the arch (curvature) of the turn, meaning that only one of the edges 2, 3 is loaded. Accordingly, the curvature of the width of blade 10 interpreted in direction y, can be actually interpreted and established separately for each of the edges 2 and 3, if it is possible to make sure that same height coordinates z belong to the same coordinate x for both edges 2, 3.

The different change of width of blade 10 at the left and right sides is allowed (or required sometimes) by the willingness or the desire of the skater to turn right with different style, curvature of path or momentum relative to the left turn. For the sake of clarity, let us take the central plane interpreted in plane x-z in the middle region 1 of the blade 10 as a halving plane providing the starting (zero) line of the dimensions in direction y. Let us mark the distances of edge 3 (the upper edge according to FIG. 2) calculated from the central plane with coordinates +y, and mark the distances in the direction y of the other (lower) edge 2 with negative sign, i.e. with coordinates −y. In the anterior region 4 and/or in the posterior region 5 the edges 2 and 3 of blade 10 must be at the same height z for every length coordinate x, but their width, i.e. the width coordinates −y or +y of edges 2, 3 may be different. It is even possible theoretically, that the width increases only for the right or only for the left edge 2, 3 in the function of the length coordinate x either at the anterior region 4 or at the posterior 5 region.

Figure 3:
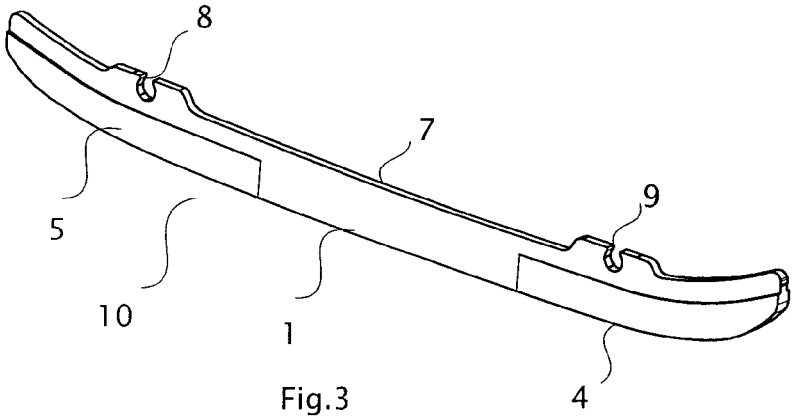
FIG. 3 is the axonometric view of another shape of design of the blade according to the invention.

FIG. 3 shows the axonometric view of another shape of design of the blade 10 according to the invention, where the middle region 1 is much shorter. Such skates are used where turning or spinning is required often and in small arches.

The arch of widening of the respective edges 2, 3 facilitates turning in the given direction, and allows turning in arch (radius of curvature) much smaller than usual. FIG. 3 shows a blade 10 of skate, which is made of alloyed steel or similarly hard material preferably with a width corresponding to the maximum thickness of edges 2, 3 diverging in forward or rearward direction, from which an upper region 7 (FIG. 3) with a constant thickness can be established by means of grinding or other machining operation, the thickness (width) of which preferably corresponds to that of the middle region 1. Preferably two connecting sections 8 and 9 of the blade 10 are located on the top of the upper region 7, by which the blade 10 can be coupled with the sole connector (not shown in the drawing).

It could be beneficial to prepare the blade 10 from two half blades (not shown in the drawing), because of the independent design of the left side and right side of the blade 10, where each half has a planar surface at one side corresponding to the central plane, and the thickness determining the other side follows the desired arched design of the associated edges 2 and 3. The half blades can be connected rigidly to each other (e.g. by means of riveting) to form a single rigid blade 10.

The respective edges 2, 3 (as has been mentioned already) could have lots of different designs according to the requirements, about which a couple of examples are shown below.

In case of Example 1, the length of the middle region 1 is 100 mm, while the anterior and posterior regions are 90 mm long alike. The blade 10 in the example has a symmetrical design relative to the central plane 6. The change of width of edges 2, 3 is also identical at front and at the rear, but their heights are different.

TABLE 1

| Length X (mm) | −140 | −130 | −120 | −110 | −100 | −90 | −80 | −70 | −60 | −50 | −40 | −30 | −20 | −10 |
|---|---|---|---|---|---|---|---|---|---|---|---|---|---|---|
| Total thickness (mm) | 4.69 | 4.33 | 4.02 | 3.75 | 3.52 | 3.33 | 3.19 | 3.08 | 3.02 | 3.00 | 3.00 | 3.00 | 3.00 | 3.00 |
| Half thickness Y (mm) | 2.35 | 2.17 | 2.01 | 1.88 | 1.76 | 1.67 | 1.60 | 1.54 | 1.51 | 1.50 | 1.50 | 1.50 | 1.50 | 1.50 |
| Blade height Z (mm) | 11.70 | 7.71 | 5.41 | 3.64 | 2.50 | 1.75 | 1.29 | 0.75 | 0.30 | 0.00 | 0.00 | 0.00 | 0.00 | 0.00 |

| Length X (mm) | 0 | 10 | 20 | 30 | 40 | 50 | 60 | 70 | 80 | 90 | 100 | 110 | 120 | 130 | 140 |
|---|---|---|---|---|---|---|---|---|---|---|---|---|---|---|---|
| Total thickness (mm) | 3.00 | 3.00 | 3.00 | 3.00 | 3.00 | 3.00 | 3.02 | 3.08 | 3.19 | 3.33 | 3.52 | 3.75 | 4.02 | 4.33 | 4.69 |
| Half thickness Y (mm) | 1.50 | 1.50 | 1.50 | 1.50 | 1.50 | 1.50 | 1.51 | 1.54 | 1.60 | 1.67 | 1.76 | 1.88 | 2.01 | 2.17 | 2.35 |
| Blade height Z (mm) | 0.00 | 0.00 | 0.00 | 0.00 | 0.00 | 0.00 | 0.30 | 0.70 | 1.20 | 1.64 | 2.50 | 4.05 | 6.29 | 9.71 | 15.96 |

Figure 4:
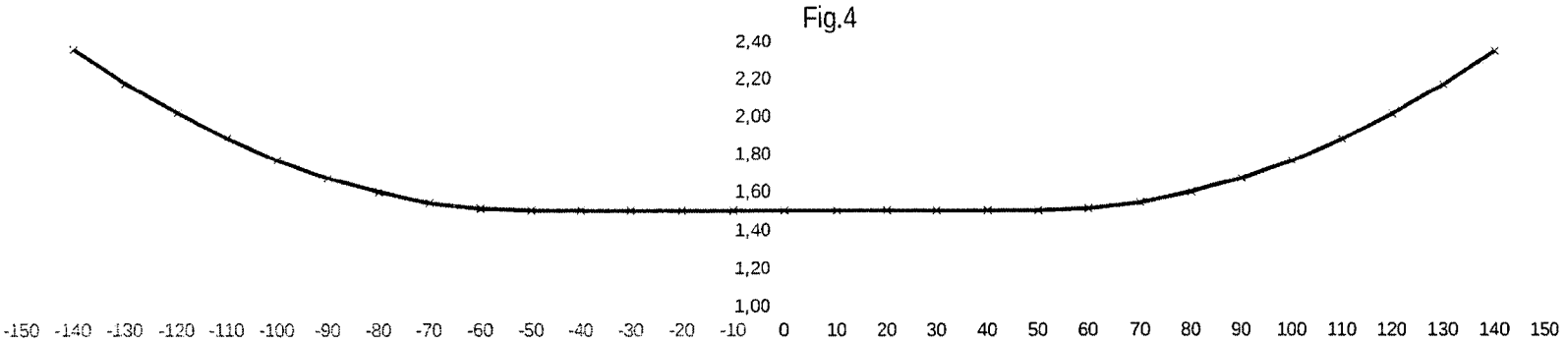
FIG. 4 and FIG. 5 show the height and width of edges in the function of the length for another shape of design.
Figure 5:
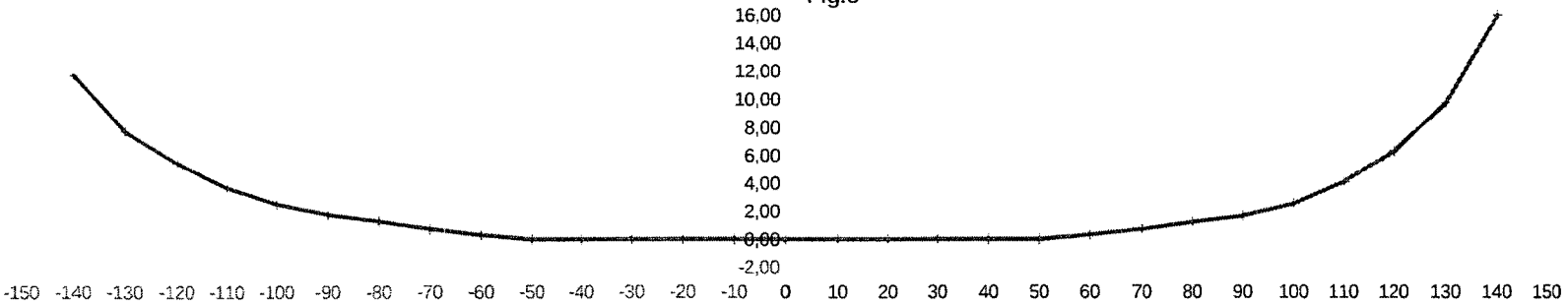

The height-length and width-length diagrams for the design of blade 10 corresponding to Example 1 are shown in FIG. 4 and FIG. 5.

Example 2 and the associated Table 2 refer to a blade 10, which has a shorter middle region 1, which is only 60 mm long. The total length of blade 10 is also 280 mm in this case. The symmetry of the increase of thickness at the anterior and posterior regions is true also in this example.

TABLE 2

| Length X (mm) | −140 | −130 | −120 | −110 | −100 | −90 | −80 | −70 | −60 | −50 | −40 | −30 | −20 | −10 |
|---|---|---|---|---|---|---|---|---|---|---|---|---|---|---|
| Total thickness (mm) | 4.35 | 4.10 | 3.90 | 3.72 | 3.56 | 3.42 | 3.30 | 3.20 | 3.12 | 3.06 | 3.02 | 3.00 | 3.00 | 3.00 |
| Half thickness Y (mm) | 2.18 | 2.05 | 1.95 | 1.86 | 1.78 | 1.71 | 1.65 | 1.60 | 1.56 | 1.53 | 1.51 | 1.50 | 1.50 | 1.50 |
| Blade height Z (mm) | 11.70 | 7.71 | 5.41 | 3.64 | 2.50 | 1.75 | 1.29 | 0.98 | 0.65 | 0.42 | 0.18 | 0.00 | 0.00 | 0.00 |

| Length X (mm) | 0 | 10 | 20 | 30 | 40 | 50 | 60 | 70 | 80 | 90 | 100 | 110 | 120 | 130 | 140 |
|---|---|---|---|---|---|---|---|---|---|---|---|---|---|---|---|
| Total thickness (mm) | 3.00 | 3.00 | 3.00 | 3.00 | 3.02 | 3.06 | 3.12 | 3.20 | 3.30 | 3.42 | 3.56 | 3.72 | 3.90 | 4.10 | 4.35 |
| Half thickness Y (mm) | 1.50 | 1.50 | 1.50 | 1.50 | 1.51 | 1.53 | 1.56 | 1.60 | 1.65 | 1.71 | 1.78 | 1.86 | 1.95 | 2.05 | 2.18 |
| Blade height Z (mm) | 0.00 | 0.00 | 0.00 | 0.00 | 0.19 | 0.40 | 0.60 | 0.85 | 1.23 | 1.64 | 2.50 | 4.05 | 6.29 | 9.71 | 14.95 |

Figure 6:
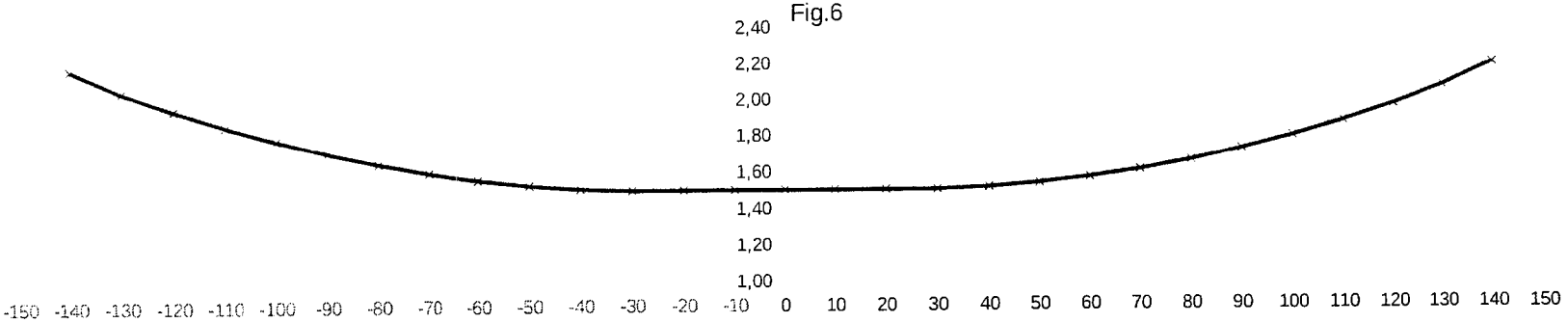
FIG. 6 and FIG. 7 show the height and width of edges in the function of the length for yet another shape of design.
Figure 7:
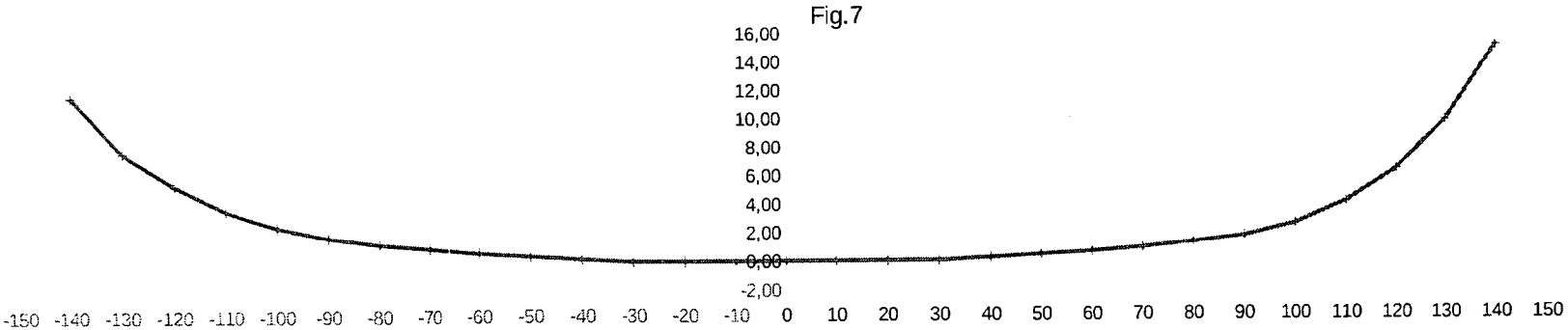

The height-length and width-length diagrams for the design of blade 10 corresponding to Example 2 are shown in FIG. 6 and FIG. 7.

Example 3 and the associated Table 3 refer to a blade 10, which has an even shorter middle region 1, which is only 40 mm long. The total length of blade 10 is also 280 mm in this case. The symmetry of the increase of thickness at the anterior and posterior regions is true also in this example.

2, 3 of the blade 10 is not the same relative to the central plane 6. In case of such a design, the turning to the left and turning to the right is influenced and facilitated by the blade 10 differently. In addition to the introduced example, the asymmetry of the edges 2, 3 of the blade can be accomplished with many other curvatures, and the dimensioning depends primarily on the preferences of the skater.

TABLE 3

| Length X (mm) | −140 | −130 | −120 | −110 | −100 | −90 | −80 | −70 | −60 | −50 | −40 | −30 | −20 | −10 |
|---|---|---|---|---|---|---|---|---|---|---|---|---|---|---|
| Total thickness (mm) | 4.35 | 4.15 | 3.98 | 3.80 | 3.65 | 3.51 | 3.39 | 3.27 | 3.18 | 3.12 | 3.07 | 3.04 | 3.02 | 3.00 |
| Half thickness Y (mm) | 2.18 | 2.08 | 1.99 | 1.90 | 1.83 | 1.76 | 1.70 | 1.64 | 1.59 | 1.56 | 1.54 | 1.52 | 1.51 | 1.50 |
| Blade height Z (mm) | 11.70 | 7.71 | 5.41 | 3.64 | 2.50 | 1.75 | 1.30 | 1.05 | 0.80 | 0.58 | 0.35 | 0.15 | 0.02 | 0.00 |

| Length X (mm) | 0 | 10 | 20 | 30 | 40 | 50 | 60 | 70 | 80 | 90 | 100 | 110 | 120 | 130 | 140 |
|---|---|---|---|---|---|---|---|---|---|---|---|---|---|---|---|
| Total thickness (mm) | 3.00 | 3.00 | 3.02 | 3.04 | 3.07 | 3.12 | 3.18 | 3.27 | 3.39 | 3.51 | 3.65 | 3.80 | 3.98 | 4.15 | 4.35 |
| Half thickness Y (mm) | 1.50 | 1.50 | 1.51 | 1.52 | 1.54 | 1.56 | 1.59 | 1.64 | 1.70 | 1.76 | 1.83 | 1.90 | 1.99 | 2.08 | 2.18 |
| Blade height Z (mm) | 0.00 | 0.00 | 0.02 | 0.15 | 0.42 | 0.66 | 0.95 | 1.25 | 1.55 | 1.90 | 2.60 | 4.05 | 6.29 | 9.71 | 14.95 |

Figure 8:
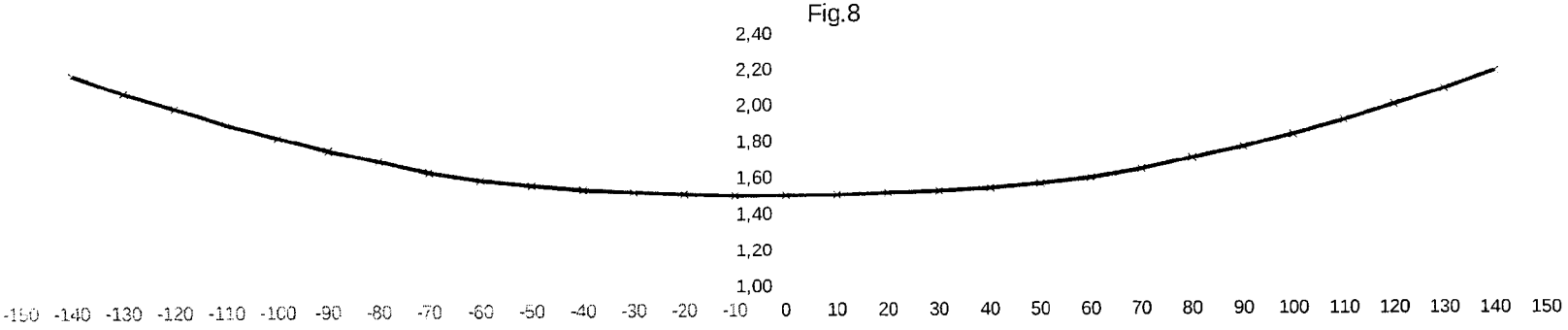
FIG. 8 and FIG. 9 show the height and width of edges in the function of the length for a further shape of design.
Figure 9:
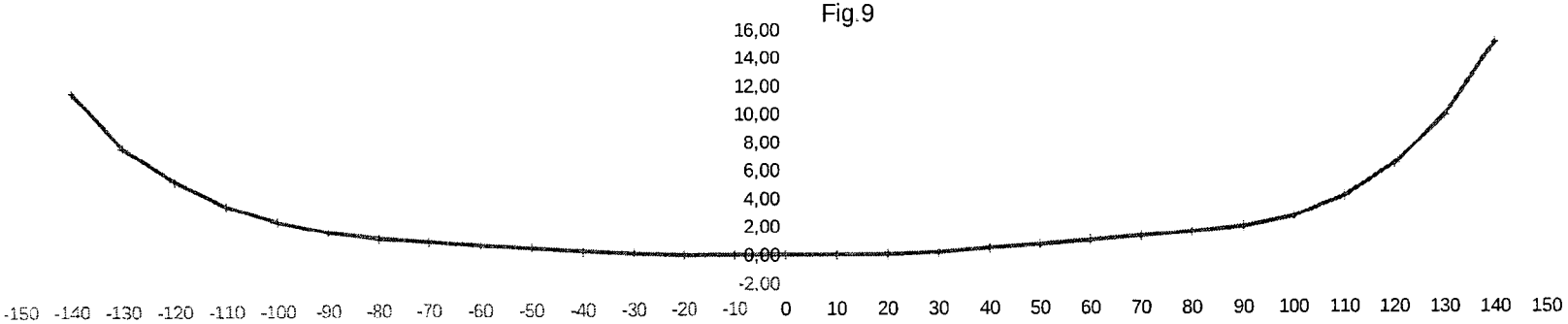

The height-length and width-length diagrams for the design of blade 10 corresponding to Example 3 are shown in FIG. 8 and FIG. 9.

Figure 10:
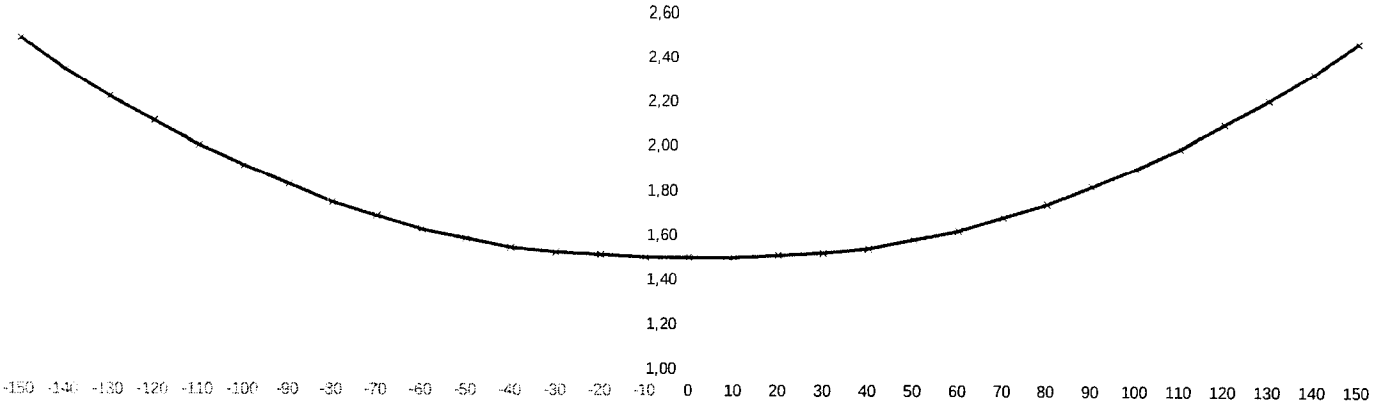
FIG. 10 and FIG. 11 show the distance of edges from the central plane for a shape of design where the width of edges changes asymmetrically.
Figure 11:
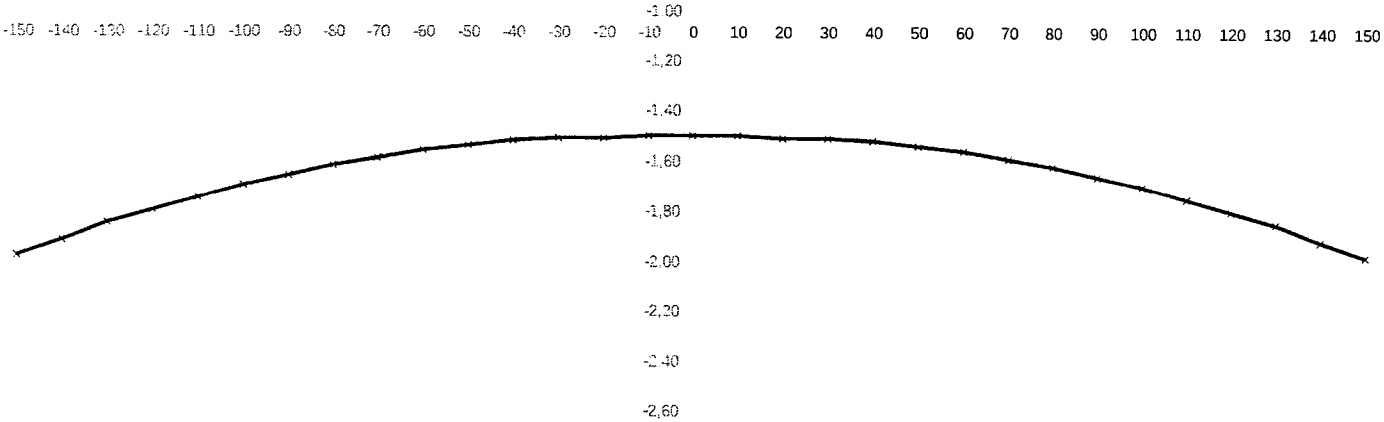
Figure 12:
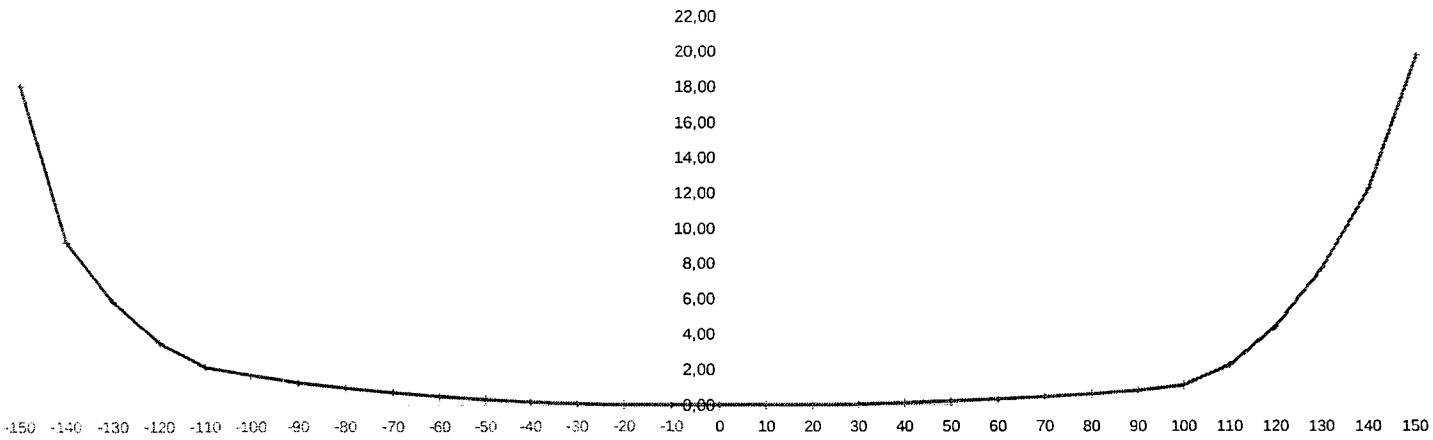
FIG. 12 shows the height z of the asymmetric blade depicted in FIG. 10 and FIG. 11 in the function of coordinate x.

Example 4 refers to a blade with asymmetric blade design, where the distance (width) measured in direction y of edges The coordinates of the blade corresponding to Example 4 are summarised in Table 4, and at the same time, the diagrams shown in FIG. 10 and FIG. 11 show the change of coordinates +y and −y in the function of coordinate x. Finally, FIG. 12 shows a diagram that illustrates the height z of edges 2, 3 in the function of coordinate x.

TABLE 4

| Length X (mm) | −150 | −140 | −130 | −120 | −110 | −100 | −90 | −80 | −70 | −60 | −50 |
|---|---|---|---|---|---|---|---|---|---|---|---|
| Upper thickness + Y (mm) | 2.46 | 2.31 | 2.17 | 2.04 | 1.93 | 1.83 | 1.74 | 1.67 | 1.61 | 1.56 | 1.53 |
| Lower thickness − Y (mm) | −1.98 | −1.90 | −1.83 | −1.77 | −1.71 | −1.66 | −1.62 | −1.58 | −1.55 | −1.53 | 1.51 |
| Blade height Z (mm) | 17.86 | 9.01 | 5.51 | 3.06 | 1.56 | 0.98 | 0.72 | 0.50 | 0.35 | 0.18 | 0.08 |

| Length X (mm) | −40 | −30 | −20 | −10 | 0 | 10 | 20 | 30 | 40 | 50 | 60 | 70 |
|---|---|---|---|---|---|---|---|---|---|---|---|---|
| Upper thickness Y (mm) | 1.51 | 1.50 | 1.50 | 1.50 | 1.50 | 1.50 | 1.50 | 1.50 | 1.51 | 1.53 | 1.56 | 1.61 |
| Lower thickness Y (mm) | −1.50 | −1.50 | −1.50 | −1.50 | −1.50 | 1.50 | 1.50 | 1.50 | 1.50 | 1.51 | −1.53 | −1.55 |
| Blade height Z (mm) | 0.02 | 0.00 | 0.00 | 0.00 | 0.00 | 0.00 | 0.00 | 0.00 | 0.01 | 0.05 | 0.11 | 0.20 |

| Length X (mm) | 80 | 90 | 100 | 110 | 120 | 130 | 140 | 150 |
|---|---|---|---|---|---|---|---|---|
| Upper thickness Y (mm) | 1.67 | 1.74 | 1.83 | 1.93 | 2.04 | 2.17 | 2.31 | 2.46 |
| Lower thickness Y (mm) | −1.58 | −1.62 | −1.66 | −1.71 | −1.77 | −1.83 | −1.90 | −1.98 |

TABLE 4-continued

| | | | | | | | | |
|---|---|---|---|---|---|---|---|---|
| Bladed height Z (mm) | 0.31 | 0.45 | 0.74 | 1.94 | 4.17 | 7.53 | 12.15 | 19.68 |

The design of edges 2, 3 of the blade 10 according to the invention can be varied within a wide range in harmony with the requirements and individual preferences of the skater. The shapes of design can be changed without deviating from the essential concept of the invention as long as the parallel alignment and the z=0 height of edges 2, 3 are kept in the middle region 1, and then the width y of at least one of the edges 2, 3 increases within the anterior region 4 and/or within posterior region 5 along axis x corresponding to a continuous arched curvature departing from the middle region 1.

The blade 10 designed according to the invention ensures the usual possibilities while moving along a straight path, and at the same time, the increase of the width along a curved arch provides rather significant advantages during turning, which become evident in the aesthetics of skating and in the improved maneuverability.

In FIGS. 13*a-d* and in the associated FIGS. 14*a* and *b* a further shape of design is illustrated, which has particularly beneficial turning properties. The direction of movement is shown with an arrow in FIGS. 15*a-d*. As shown in FIG. 13*a*, the anterior region 4' of right blade 11 beneath the right leg of the skater has an edge parallel with the central plane at the left side, while at the right side, it has an anterior edge section 12 which widens in forward direction along an arch. The scale is distorted in lateral direction in the drawing for the sake of better understanding. At the posterior region 5', a rear edge section 13 is established at the opposite side, i.e. at the left blade side as viewed in direction of movement.

In case of the other, i.e. the right blade 14, the conditions are opposite relative to the left blade 11, meaning that there is an arched front edge section 15, which becomes wider to the left, and there is a rear edge section 16, which becomes wider to the right.

Naturally, in the line of the mentioned edge section, the blade is locate at elevated location in direction z, therefore, these sections do not touch the ice surface while moving along a straight path, and therefore, they do not cause braking affect.

Figure 14B:
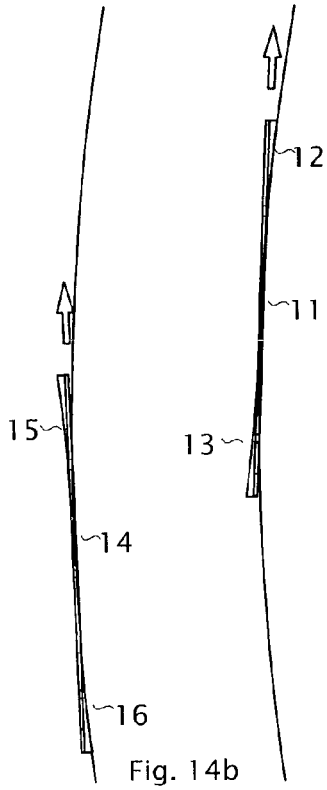
Figure 15A:
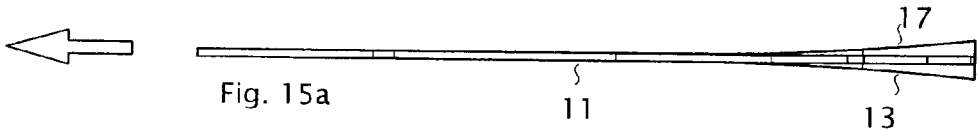
Figure 15B:
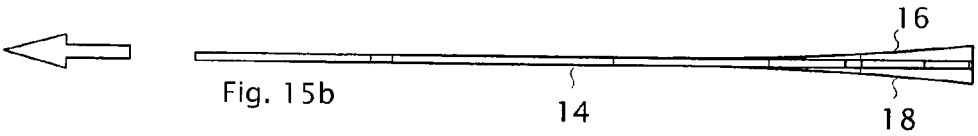
Figure 15C:
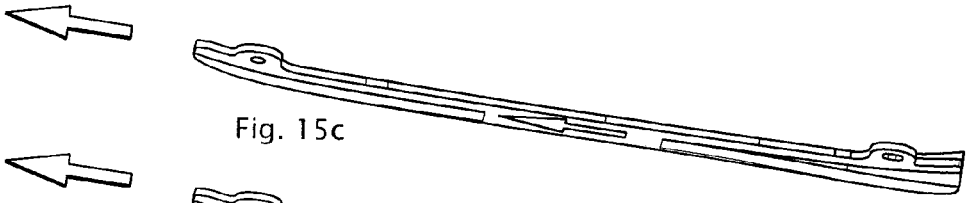
Figure 15D:
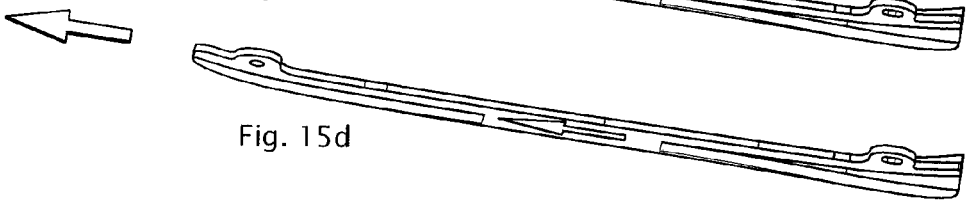

The effect and advantages of the blade design described here can be observed in FIG. 14*a* and FIG. 14*b*. The sketch in FIG. 14*a* shows the left blade 14 and the right blade 11 in case of moving in a left turn. The thin line indicates the path of the movement. It is known, that the leg towards the direction of the curvature of the turn is always in front and the other leg is behind during skating, and the leaning of the leg makes the blade lean forward at the front leg, while the leaning of the rear leg is opposite. As can be seen in FIG. 14*a*, the anterior edge section 15 touching the ice at the left leg accurately follows the arch of the turn, thus facilitating an efficient turning. At the same time, the outside leg, which is the right leg in this case, the posterior edge section 13 (or its part) touches the ice, and this also follows and facilitates turning. The other two edge sections 16 and 12 have no significance when turning in forward direction. If the skater strides backwards and turns along the same arch, then the edge section 16 and 12, which did not touch the ice formerly, will ensure the same effect.

FIG. 14*b* shows a turn with opposite curvature, where the right leg is in front and the left leg is behind. When proceeding forward, the edge section 12 of right blade 11 and the edge section 16 of left blade 14 touches the ice, and follows the arch of the route well, and facilitates the movement and the turning. Now the edge sections 15 and 13 do not touch the ice, and their arch is indifferent. When the direction of movement is reversed, then the roles of the edge sections are exchanged.

FIGS. 15*a-d* and FIGS. 16*a, b* show a further shape of design, where only the rear sections 5' of the blades are arched, but in both directions. At the anterior sections 4' the blades have parallel edges. Similarly to the above shape of design, the edge sections 13 and 16, that become wider outwards and rearwards along an arch, are present at the posterior section 5', but edge sections 17 and 18 are also present at the other sides. The right rear arch section 18 of the left blade 14, as well as the right edge section 17 of the right blade 11 is aligned tangentially to the arch of the movement when turning to the left.

Although in case of this shape of design the anterior blade region is parallel, the arched design of the posterior blade region facilitates turning, and this design has significant advantages also relative to the traditional parallel design.

A further conclusion can be considered based on FIGS. 14*a* and *b* and FIGS. 16*a* and *b*. The left leg moves along an arch having smaller radius relative to the right leg when turning to the left, while the situation is opposite, when turning to the right. Consequently, it does not mean that the same curvature should be present on the otherwise parallel edge section 16, 18 of the left blade 14 in the case shown in FIGS. 15*a-d*, where the edge sections 13, 17 of the right blade 11 are symmetrical to each other. This is because the left leg and the right leg move along different arches, and this justifies the fact, that the radius of curvature of the arched section on the left blade is slightly different from that of the right blade.

Naturally, the mentioned asymmetry is very beneficial also in case of edges being right and left of the central plane of the same blade, for the first version of which an example is given by the case depicted in FIGS. 13*a-d*, where one side of the anterior section of each blade is arched, while the other side is arched at the posterior section.

Therefore, the solution according to the invention efficiently utilizes the fact, that only the middle region 1 of the skate blade touches the ice when moving along a straight path, and the edges have to be parallel only at this region, while the blade sections in front and behind the middle region are elevated gradually, and very advantageous turning properties are made possible by a gradual change of their width here, and it is particularly beneficial to have a slightly asymmetric design within these possibilities. The asymmetry may refer to the differences between the right and left blades, as well as to the asymmetry of edge sections established at the two sides of a blade.

The invention claimed is:

1. A skate blade (10) for skating shoes, comprising a length, a width, an external and an internal edge (2, 3), said blade (10) can be divided along its length to three adjoining regions, namely a posterior region (5), a middle region (1), and an anterior region (4), where a coordinate system with mutually normal directions x, y and z can be associated with a central plane (6) halving the blade at the middle region (1), wherein a direction x designates a distance in forward direction of an edge point, a direction y designates a lateral distance of an edge point from the central plane (6) and a direction z designates a height of an edge point from the height of the edge in the middle region (1), in which at any edge point with a coordinate x the height z of both edges (2,3) are the same, and in the middle region (1) the external and the internal edges (2, 3) are parallel, and have a zero height (z=0) and in the anterior and posterior regions (4, 5) the edges (2, 3) have a height greater than zero, and in at least one of the anterior and posterior regions (4, 5) the width of the blade (10) increases with the absolute value of the coordinate x along an arced curve, characterized in that the increase in width of the external or internal edges (2 or 3) is different from the width of the other edge (3 or 2).

2. The skate blade of claim 1, wherein a right blade (11) attached to a right shoe and a left blade (14) attached to a left shoe belong to a pair of skating shoes, characterized in that the right and left blades (11, 14) have edge sections that become wider along different arcs.

3. The skate blade of claim 2, wherein in the rear edge section (17, 13, 16, 18) that becomes wider along a rearward arc is established only at the posterior region (5) of both blades (11, 14).

4. The skate blade of claim 2, wherein both anterior and posterior regions (4' and 5') of both blades (11, 14) contain only one widening section but at an opposite side, wherein an orientation of said widening section is different on the right blade (11) relative to the left blade (14).

* * * * *